US005476240A

United States Patent [19]

McDonough

[11] Patent Number: 5,476,240

[45] Date of Patent: Dec. 19, 1995

[54] PAINTBRUSH HOLDER

[76] Inventor: Francis P. McDonough, P.O. Box 396, Zephr Cove, Nev. 89448

[21] Appl. No.: 284,370

[22] Filed: Aug. 2, 1994

[51] Int. Cl.[6] ..... A47G 29/18

[52] U.S. Cl. ..... 248/213.2; 211/65; 248/112; 248/303

[58] Field of Search ..... 248/213.2, 112, 248/690, 692, 303; 211/65, 66

[56] References Cited

U.S. PATENT DOCUMENTS

| | | | |
|---|---|---|---|
| 742,417 | 10/1903 | Hammerstrom | 248/303 |
| 846,758 | 3/1907 | Pike | 211/106 |
| 1,176,009 | 3/1916 | Weimar | 248/213.2 |
| 1,220,717 | 3/1917 | Bennett | 248/303 |
| 1,286,014 | 11/1918 | Jetmund . | |
| 1,343,381 | 6/1920 | Afranel . | |
| 1,797,381 | 3/1931 | Trimble | 248/303 |
| 2,450,736 | 10/1948 | Pierce | 248/112 |
| 2,492,042 | 12/1949 | Hoffman | 248/112 |
| 2,823,399 | 2/1958 | Stewart | 248/213.2 |
| 2,852,144 | 9/1958 | Reno | 211/65 |
| 3,203,658 | 8/1965 | Brown | 248/303 |
| 3,220,682 | 11/1965 | Hannon | 248/303 |
| 4,025,206 | 5/1977 | Rubin | 248/112 |

*Primary Examiner*—Leslie A. Braun
*Assistant Examiner*—Anita M. King
*Attorney, Agent, or Firm*—Blodgett & Blodgett

[57] ABSTRACT

A paintbrush holder having a hook portion for attachment to the upper rim of a paint bucket and at least three transverse segments wherein one segment engages one surface of the paintbrush handle and the other two segments engage the opposite surface of the paintbrush handle. The holder is made of a springy material wherein the transverse segments are biased against the handle for clamping the handle therebetween so that the paintbrush is securely supported by the holder and is also adjustably positioned relative to the holder.

14 Claims, 4 Drawing Sheets

PAINTBRUSH HOLDER

BACKGROUND OF THE INVENTION

The present invention relates to a holder for a paintbrush which is attachable to the upper rim of an open container such as a bucket so that the paintbrush extends into the interior of the bucket. This enables the bristles of the paintbrush to be spaced from the bottom of the bucket but submerged in the water or other cleaning fluid within the bucket, thereby keeping the bristles soft and pliable. This prevents the bristles from being bent out of shape, which occurs where an unsupported paintbrush rests on the bottom of a bucket and the weight of the brush head and handle are supported entirely by the bristles.

Many types of holding devices have been developed for holding a paintbrush and for application to a bucket. Many of these devices include a springy wire which is configured to a shape for attachment to the handle of a paintbrush and for attachment to the upper rim of a bucket so that the brush is suspended in cleaning fluid within the bucket. The prior art devices have relatively complex and awkward configurations which are difficult to make and use or have a relatively simple configuration which does not satisfactorily hold the handle of a paintbrush firmly and securely. The prior art paintbrush holders have limited versatility with respect to the size of the paintbrush and the size of the container with which the holder can be used. These and other difficulties experienced with the prior art paintbrush holders have been obviated by the present invention.

It is, therefore, a principle object of the invention to provide a paintbrush holder for attachment to the upper rim with a bucket and for securely and adjustably supporting a paintbrush so that the brush extends into the interior of the bucket and is spaced from the bottom of the bucket.

Another object of the invention is the provision of a paintbrush holder which can be used with buckets of different sizes.

A further object of the present invention is the provision of a paintbrush holder which can be used with brushes of different sizes.

It is another object of the present invention to provide a paintbrush holder which is attachable to the rim of a bucket and which enables the paintbrush to be adjustably vertically positioned within the interior of the bucket.

A still further object of the invention is the provision of a paintbrush holder which is simple in construction, which is inexpensive to manufacture, and which is capable of a long life of useful service.

It is a further object of the invention to provide a paintbrush holder which is easy to use and which can remain on the brush while painting without interfering with gripping the brush.

With these and other objects in view, as will be apparent to those skilled in the art, the invention resides in the combination of parts set forth in the specification and covered by the claims appended hereto.

SUMMARY OF THE INVENTION

In general, the invention consists of a paintbrush holder having a hook portion for attachment to the upper rim of a paint bucket and at least three transverse segments wherein one segment engages one surface of the paintbrush handle and the other two segments engage the opposite surface of the paintbrush handle. The holder is made of a springy material wherein the transverse segments are biased against the handle for clamping the handle therebetween so that the paintbrush is securely supported by the holder and is also adjustably positioned relative to the holder.

BRIEF DESCRIPTION OF THE DRAWINGS

The character of the invention, however, may be best understood by reference to one of its structural forms, as illustrated by the accompanying drawings, in which.

DETAILED DESCRIPTION OF THE PREFERRED EMBODIMENT

Figure 1:
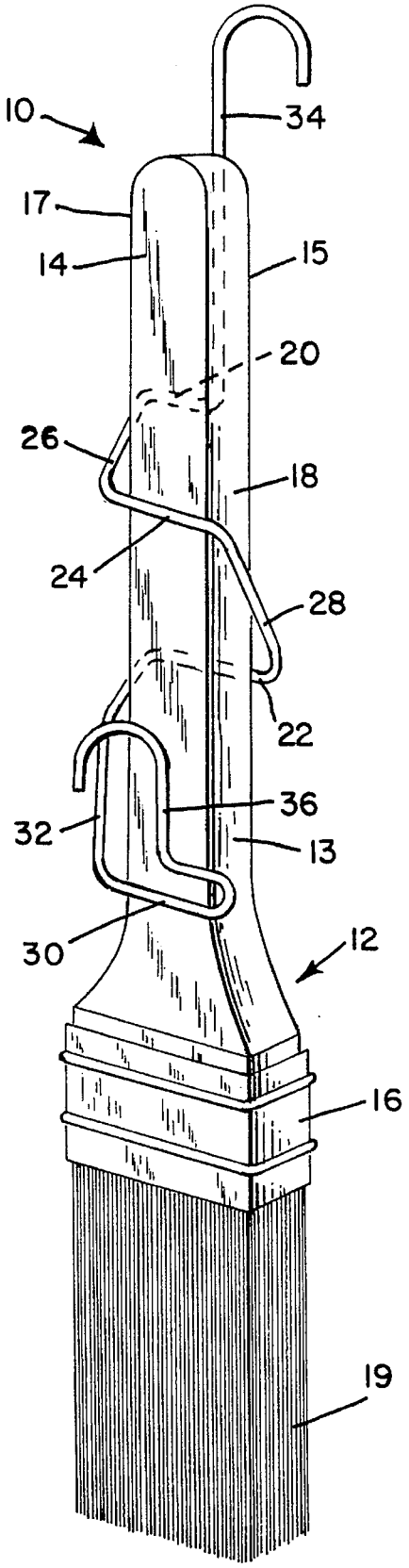
FIG. 1 is an isometric view of a paintbrush holder embodying the principles of the present invention shown applied to a paintbrush.
Figure 2:
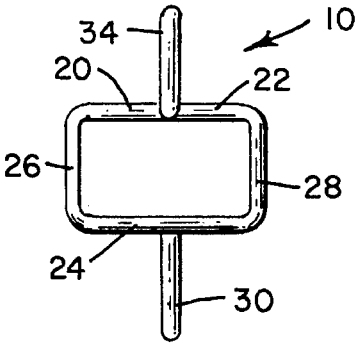
FIG. 2 is a top plan view of the holder.
Figure 3:
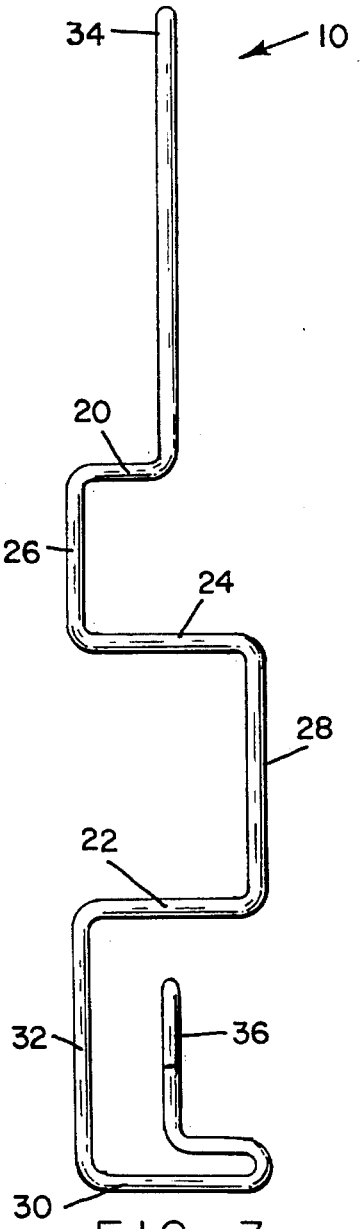
FIG. 3 is a front elevational view of the holder.
Figure 4:
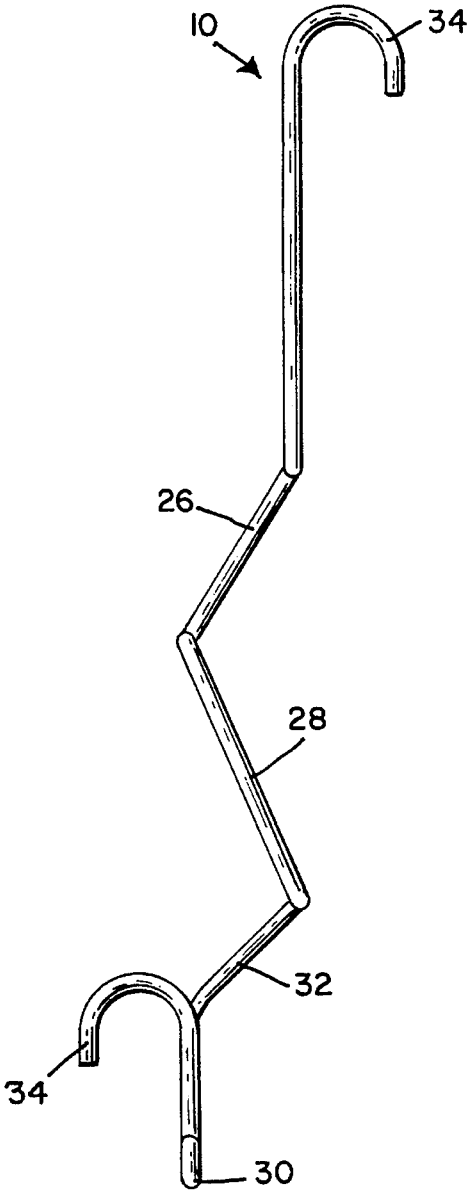
FIG. 4 is a side elevational view of the holder looking in the direction of arrow IV of FIG. 3.

Referring first to FIG. 1, the paintbrush holder of the present invention is generally indicated by the reference numeral 10 and is shown applied to the handle of a conventional paintbrush which is generally indicated by the reference numeral 12. The paintbrush 12 includes a handle 13 and a head portion 16 which contains a plurality of bristles 19. The handle 13 has a first surface 14, a second surface 15 which is opposite the first surface 14 and third and fourth surfaces 17 and 18, respectively, which are opposite one another and transverse to the first and second surfaces 14 and 15, respectively. The handle 13 which is shown in FIG. 1 is substantially rectangular in cross-section for ease of illustration with the holder of the present invention. However, the holder 10 of the present invention may be utilized with a handle having any conventional cross-section.

Referring to FIGS. 1–4, the holder 10 is made of a single continuous piece of springy material and preferably metal wire such as spring steel. The wire is formed into a plurality of segments or portions which are configured as shown in the drawings. The holder 10 has an upper free end which is formed into an upper hook portion 34 and a lower free end which is formed into a lower portion 36. The hook portions 34 and 36 extend in opposite directions as shown in the drawings. The segments of the holder which extend between the upper and lower hooks 34 and 36, respectively, include a first transverse segment 20, a second transverse segment 22 which is vertically aligned with and spaced from the first transverse segment 20. The holder 10 also includes a third transverse segment 24 and a fourth transverse segment 30 which is vertically aligned with and spaced from the third transverse segment 24. The third and fourth transverse segments 24 and 30, respectively, are horizontally offset from the first and second transverse segments 20 and 22, respectively. A first transition segment 26 extends from the first transverse segment 20 to the third transverse segment 24. A second transition segment 28 extends from the third transverse segment 24 to the second transverse segment 22. A third transition segment 32 extends from the second transverse segment 22 to the fourth transverse segment 30.

The lower hook 36 is connected to the fourth transverse segment 30. The upper hook 34 is connected to the first transverse segment 20.

The holder 10 is applied to the handle of a paintbrush such as the handle 13 as shown in FIG. 1 by vertically aligning the holder 10 with the handle 13 and moving the holder and handle toward each other so that the third and fourth transfer segments 24 and 30, respectively, engage the first surface 14 of the handle and the first and second transverse segments 20 and 22, respectively, engage the opposite surface 15 of the handle. The second transition segment 28 is adjacent the surface 18 and is spaced from the surface 18. The first and third transition segments 26 and 32, respectively, are adjacent the surface 17 of the handle and is spaced from the surface 17. The third and fourth transfer segments 24 and 30 are biased against the first surface 14 and the first and second transverse segments 20 and 22 are biased against the surface 15 due to the springy nature of the brush holder 10. The holder 10 may be adjusted vertically relative to the handle 13 by applying a predetermined pulling or pushing force to the holder 10 relative to the brush 12. The frictional force between the holder and the paintbrush due to the biasing effect of the segments of the holder is sufficient to fully support the paintbrush when the holder is held by either of the hooks 32 and 34. At least three transverse segments are sufficient to firmly clamp the handle of a paintbrush, wherein two segments are on one side of the paintbrush and the third segment is on the opposite side of the paintbrush and intermediate the first two transverse segments. However, it is preferred to have four transverse segments, two on each side of the paintbrush as illustrated in the drawings.

A single hook is sufficient for supporting the holder on the rim of a can or bucket. However, it is preferred to have two hooks as shown in the preferred embodiment. One in a lower position and one in an upper position to provide added versatility to the holder so that the holder may be used in conjunction with buckets of different sizes and to accommodate brushes of different sizes.

Figure 5:
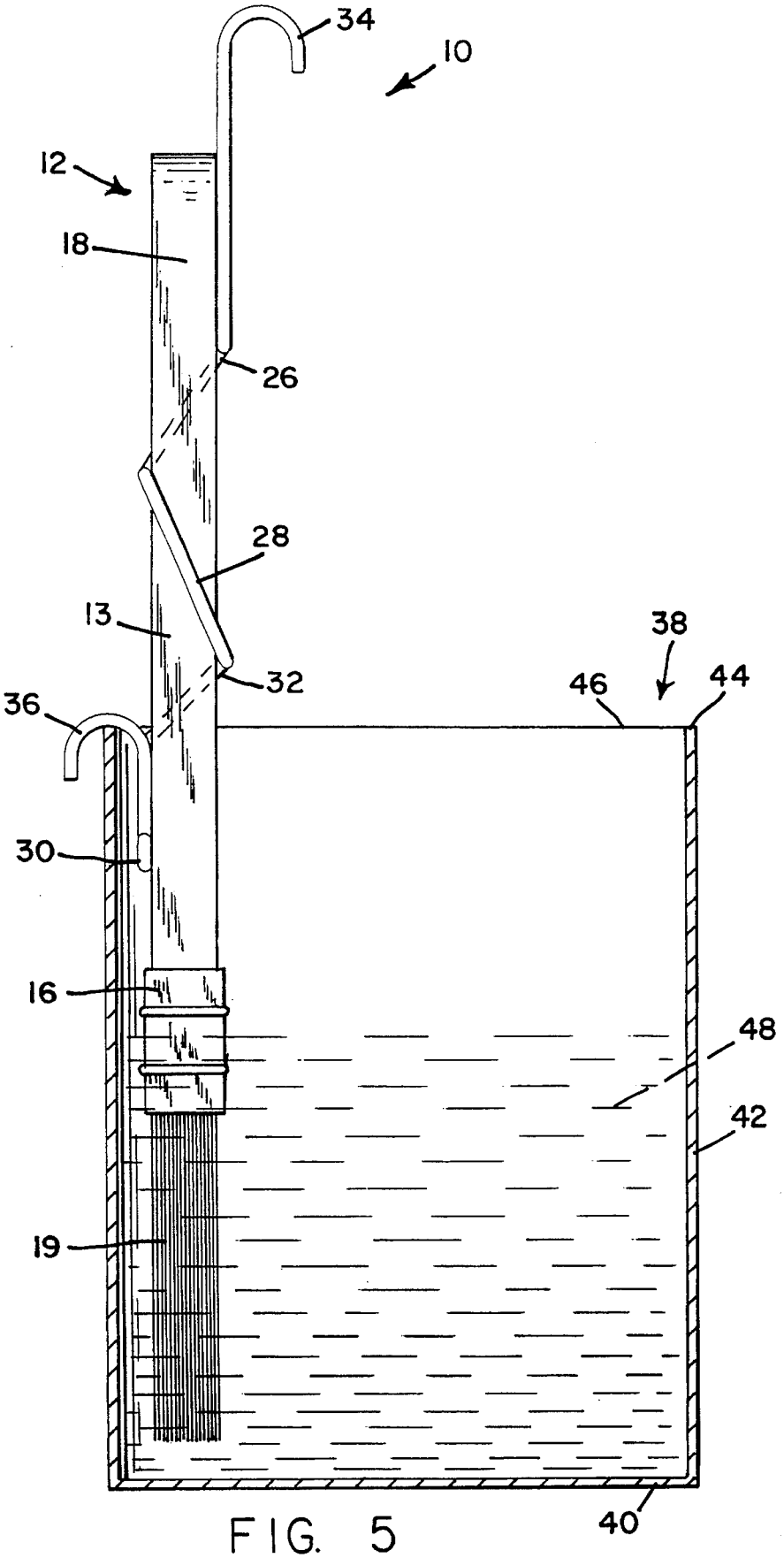
FIG. 5 is a vertical sectional view through a bucket having a holder of the present invention applied thereto, and supporting a paintbrush within the interior of the bucket.

Referring to FIG. 5, the holder 10 of the present invention is shown applied to a relatively small bucket which is generally indicated by the reference numeral 38. The bucket 38 includes a bottom wall 40, a circumferential side wall 42 which has an upper edge or rim 44 which defines a top opening 46. The bucket 38 contains cleaning fluid 48. The holder is mounted on the bucket 38 by hooking the lower hook 36 on the rim 44 as shown in FIG. 5 so that the bristles 19 of the brush extend into the cleaning fluid 48. The holder 10 is positioned vertically relative to the handle 13 so that the bottom of the bristles 19 are spaced from the bottom wall 40 of the bucket. In this way, the entire weight of the paintbrush is supported by the holder 10 which rests on the rim of the bucket and the bristles 19 are freely suspended.

Figure 6:
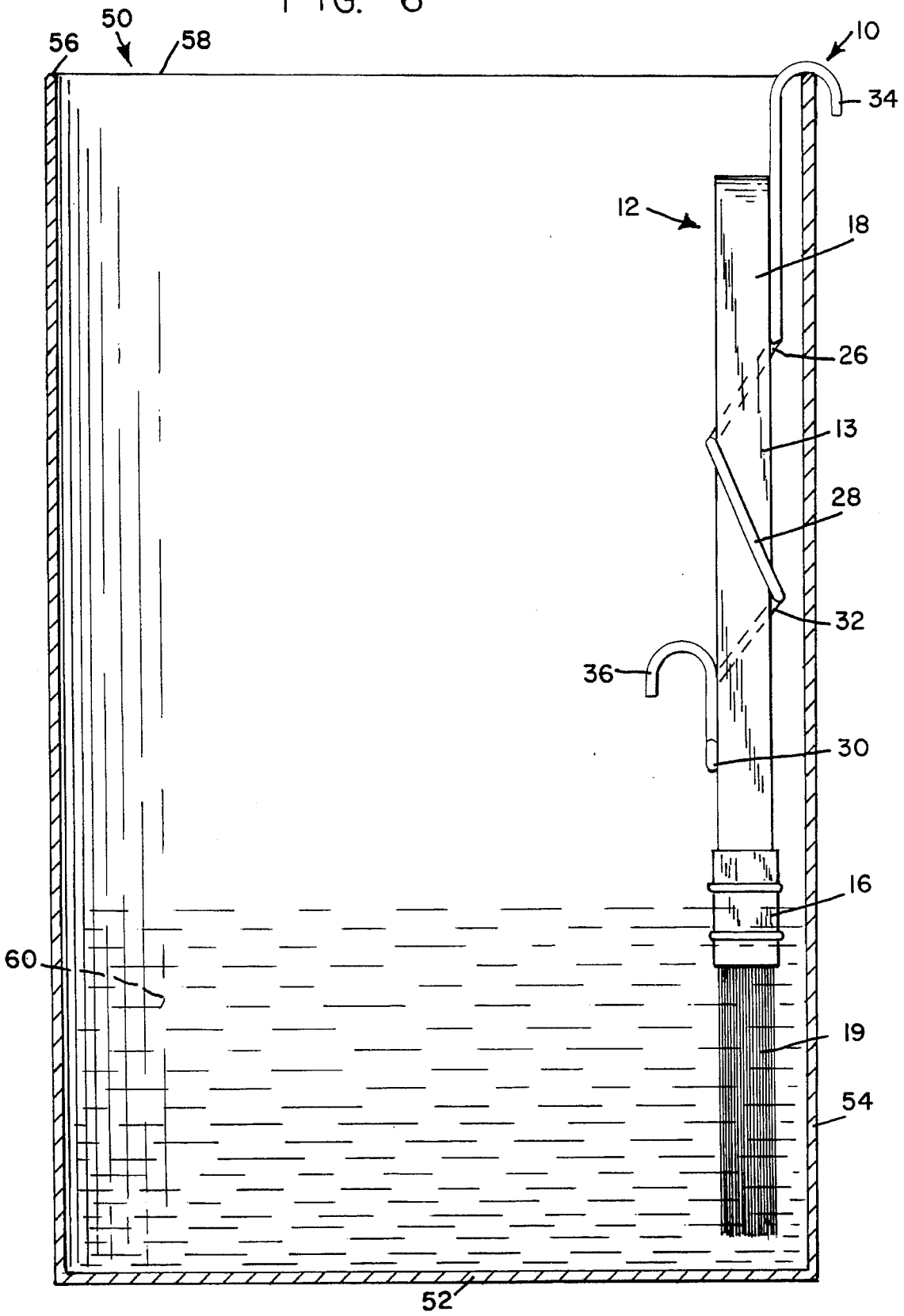
FIG. 6 is a view similar to FIG. 5 showing the holder attached to the bucket of a different size.

Referring to FIG. 6, the paintbrush holder 10 is shown applied to a relatively larger bucket generally indicated by the reference numeral 50. The bucket 50 includes a bottom wall 52, a circumferential side wall 54 which has an upper angular end edge or rim 56 which in turn defines an opening 58. The bucket 50 contains cleaning fluid 60. The holder 10 is mounted on the bucket 50 by hooking the upper hook portion 34 onto the rim 56 as shown in FIG. 6 so that the bristles 19 are spaced from the bottom wall 52. The holder 10 of the present invention can also be mounted on a larger bucket, such as a bucket 50 by means of the lower hook 36. However, the upper hook 34 enables the bristles 19 to be fully immersed in cleaning fluid without the need for completely filling the bucket with cleaning fluid.

The holder of the present invention can also be used to hold a paintbrush on a paint can during a painting operation. The holder does not interfere with the user's ability to grip the handle of the paintbrush while painting. When the paintbrush is not being used for painting, the paintbrush can be suspended within the paint can by hooking the hook portion 34 or the hook portion 36 on the upper ring of the paint can. This enables the painter to have two free hands to perform other tasks, such as scraping, before resumption of painting.

Clearly, minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A paintbrush holder for mounting in the top opening of a container having an upper edge, said paintbrush holder being made of a single piece of springy material and comprising:

(a) a first transverse segment which is located in a first vertical plane;

(b) a second transverse segment which is located in said first vertical plane, said second transverse segment being vertically aligned with and below said first transverse segment;

(c) a third transverse segment which is located in a second vertical plane that is spaced from and parallel with said first vertical plane, said third transverse segment being below said first transverse segment and above said second transverse segment;

(d) a first transition segment which extends from said first transverse segment to said third transverse segment, said first transition segment being located in third vertical plane that is normal to said first and second vertical planes;

(e) a second transition segment which extends from said third transversal segment to said second transverse segment, said second transotopm segment lying in a fourth vertical plane that is parallel with and spaced from said third vertical plane; and (f) a hook portion secured to one of said transversal segments for engaging the upper edge of said container and for supporting said paintbrush holder on said upper edge.

2. A paintbrush holder as recited in claim 1, wherein said paintbrush holder has at least one free end which is configured to form said hook portion.

3. A paintbrush holder as recited in claim 2, wherein said free end is a first free end and said hook portion is a first hook portion, said paintbrush holder further comprising a second free end which is spaced from said first free end, said second free end being configured to form a second hook portion.

4. A paintbrush holder as recited in claim 3, wherein said first hook portion is located at the top of said paintbrush holder and said second hook portion is located at the bottom of said paintbrush holder.

5. A paintbrush holder as recited in claim 1, wherein said springy material is metal.

6. A paintbrush holder as recited in claim 1, further comprising:

(a) a fourth transverse segment which is in said first vertical plane and below said second transverse segment; and (b) a third transition segment which extends from said second transverse segment to said fourth transverse segment, said third transition segment being located in said third vertical plane.

7. A paintbrush and holder assembly for mounting in the top opening of a container having an upper edge, said paintbrush and holder assembly comprising:

(a) a paintbrush comprising:

(1) a plurality of bristles;

(2) a handle having a first vertical surface, a second vertical surface which is opposite said first vertical surface, a third vertical surface which is transverse to said first and second surfaces, and a fourth vertical surface which is opposite said third vertical surface and transverse said first and second vertical surfaces; and (3) means for fixing said plurality of bristles to said handle, and (b) a holder which is made of a single piece of springy material and comprising: a first transverse segment which abuts said second vertical surface;

(2) a second transverse segment which abuts said second vertical surface and which is below said first transverse segment;

(3) a third transverse segment which abuts said first vertical surface, said third transverse segment being below said first transverse segment and above said second transverse segment;

(4) a first transition segment which extends from said first transverse segment to said third transverse segment adjacent said third vertical surface;

(5) a second transition segment which extends from said third transverse segment to said second transverse segment adjacent said fourth vertical surface, said third transverse segment being biased toward said first and second transverse segments so that sufficient pressure is applied to said handle by said first second and third transverse segments to frictionally support said paintbrush and to allow said paintbrush to slide vertically relative to said holder upon application of a predetermined vertical force to said holder relative to said paintbrush; and (6) a hook portion secured to one of said transverse segments for engaging the upper edge said container and for supporting the paintbrush and holder assembly on said upper edge.

8. A paintbrush and holder assembly as recited in claim 7, wherein said first transition segment is spaced from said third vertical surface and said second transition segment is spaced from said fourth vertical surface.

9. A paintbrush and holder assembly as recited in claim 7, wherein said paintbrush holder has at least one free end which is configured to form said hook portion.

10. A paintbrush and holder assembly as recited in claim 9, wherein said free end is a first free end and said hook portion is a fast hook portion, said paintbrush holder further comprising a second free end which is spaced from said first free end, said second free end being configured to form a second hook portion.

11. A paintbrush and holder assembly as recited in claim 10, wherein said first and second hook portion are on opposite sides of said paintbrush.

12. A paintbrush and holder assembly as recited in claim 11, wherein said first hook portion is adjacent said second vertical surface and said second hook portion is adjacent said first vertical surface.

13. A paintbrush and holder assembly as recited in claim 7, wherein said springy material is metal.

14. A paintbrush and holder assembly as recited in claim 7, further comprising:

(a) a fourth transverse segment which is vertically aligned with and spaced from said third transverse segment; and (b) a third transition segment which extends from said second transverse segment to said fourth transverse segment.

* * * * *